US005925727A

United States Patent [19]

Onda et al.

[11] Patent Number: 5,925,727

[45] Date of Patent: Jul. 20, 1999

[54] THICK AND THIN POLYAMIDE BASED FIBERS, AND A PRODUCTION PROCESS THEREOF

[75] Inventors: Kiyoshi Onda; Tetsunori Higuchi, both of Shizuoka, Japan

[73] Assignee: Toray Industries, Inc., Japan

[21] Appl. No.: 08/930,810

[22] PCT Filed: Feb. 21, 1997

[86] PCT No.: PCT/JP97/00503

§ 371 Date: Oct. 8, 1997

§ 102(e) Date: Oct. 8, 1997

[87] PCT Pub. No.: WO97/31142

PCT Pub. Date: Aug. 28, 1997

[30] Foreign Application Priority Data

Feb. 21, 1996 [JP] Japan ..... 8-33400

[51] Int. Cl.[6] ..... C08G 69/08; D02G 3/00; B32B 27/34

[52] U.S. Cl. ..... 528/310; 528/322; 528/332; 428/357; 428/364; 428/395; 428/397; 264/103; 264/129; 264/130; 264/210.8; 264/211.15; 264/211.17

[58] Field of Search ..... 528/310, 332, 528/322; 428/357, 364, 395, 397; 264/103, 129, 130, 210.8, 211.15, 211.17

[56] References Cited

U.S. PATENT DOCUMENTS

| | | | |
|---|---|---|---|
| 4,242,862 | 1/1981 | Negishi et al. | 264/288.8 |
| 4,969,322 | 11/1990 | Sasaki et al. | 428/395 |
| 5,259,098 | 11/1993 | Gupta | 28/246 |
| 5,360,667 | 11/1994 | Boles, Jr. et al. | 428/364 |

*Primary Examiner*—P. Hampton-Hightower
*Attorney, Agent, or Firm*—Austin R. Miller

[57] ABSTRACT

A material and product excellent in stability in the yarn forming process, small in the color shade contrast due to dyeing, to provide natural irregularity, having microscopic unevenness on the surface of a fabric, to provide dry touch to the eyes and by touch, and good in color fastness are disclosed.

The polyamide based fibers of the present invention is a thick and thin yarn in which the unevenness of thickness in the length direction of the polyamide based multifilament is 5 to 20% and in which the standard deviation of the stress at 40% elongation in the stress-strain curve with a sample length of 20 cm is 0.3 g/d or less. The thick and thin yarn can be produced by a process, in which an undrawn polyamide based multifilament of $20\times10^{-3}$ or less in birefringence $\Delta n$ is drawn at a low ratio, comprising the steps of falsely twisting it at a position between a feed roller and a draw roller, drawing from 1.5 to 2.5 times, and thermosetting at 100° C. to 200° C.

9 Claims, 1 Drawing Sheet

THICK AND THIN POLYAMIDE BASED FIBERS, AND A PRODUCTION PROCESS THEREOF

TECHNICAL FIELD

The present invention relates to a thick and thin polyamide based multifilament having dry touch and a, rustling touch, capable of manifesting a difference of color shade over a short periodic length when dyed, and having excellent color fastness.

BACKGROUND ART

Polyamide fibers have been mass-produced for clothing, industrial use and interior use because of their excellent fiber properties. However, polyamide fibers, particularly fibers obtained from nylon 6, 66, etc. are poor in dry touch as presented by polyesters used as general purpose fibers, and have a greasy touch. For reducing the greasy touch, the use of thick and thin yarns has been attempted.

For production of thick and thin polyamide fibers, as techniques for causing melt fractures by use of abnormal flow at the spinneret, those disclosed in Japanese Patent Publication (Kokoku) Nos. 42-22576 and 44-7744 are publicly known. Furthermore, Japanese Patent Publication (Kokoku) No. 44-15573 discloses a method of spinning in a stress range to cause melt fractures by mixing a polyamide based polymer with a material having poor compatibility with the polymer. Moreover, Japanese Patent Laid-Open (Kokai) No. 55-122017 discloses a thick and thin yarn made of a composition obtained by mixing a polyester and a polyamide. Still furthermore, Japanese Patent Laid-Open (Kokai) No. 58-36210 discloses a method comprising the steps of blend-spinning a polyamide and a thermoplastic polymer 80° C. or higher in glass transition temperature, and drawing at a low ratio. However, all of the above methods are poor in stability in the yarn forming process, and yarn breaking is likely to occur, making continuous production difficult.

Japanese Patent Laid-Open (Kokai) No. 63-211335 discloses a thick and thin yarn changing in sectional area in the axial direction by heat-treating an undrawn polyamide yarn at 110° C. to 200° C., to keep the crystallinity at 35% or more, and subsequently drawing at a low ratio of 1.2 to 3.0 times. However, the multifilament obtained is as long as many centimeters to several meters in the periodic length of thickness unevenness in the length direction of the multifilament, and furthermore, even though thickness unevenness can be obtained since the crystallinity of the undrawn yarn is enhanced before irregular drawing, the color shade contrast obtained when dyed is weak, and the color fastness is poor, and lowers the commercial value.

DISCLOSURE OF THE INVENTION

The present invention is intended to obtain fibers to provide a color shade contrast short that is in periodic length when dyed, and also to provide natural irregularity and microscopic unevenness on the surface of the fabric produced from the fibers, in a material with a dry touch and a rustling touch to the eyes, and by touch.

The object of the present invention can be achieved by providing thick and thin polyamide based fibers, characterized in that the unevenness of thickness in the length direction of the polyamide based multifilament is 5 to 20% expressed as Uster Evenness value and that the standard deviation of stress at 40% elongation in the stress-strain curve, with a sample length of 20 cm, is 0.3 g/d or less.

Figure 1:
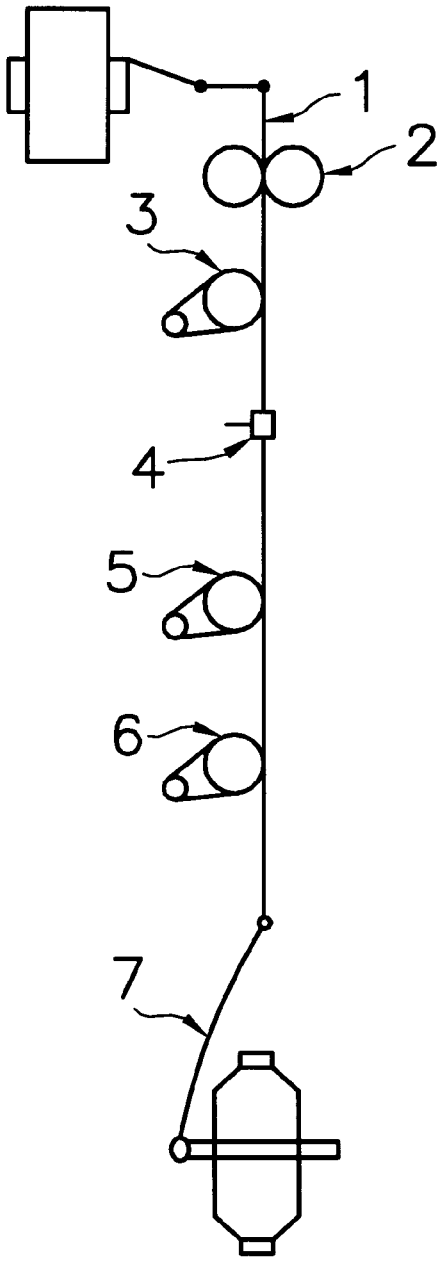
FIG. 1 is one example of a drawing machine, useful in the present invention, for producing a thick and thin yarn using an undrawn yarn.

In the drawings, symbols 1 and 10 indicate undrawn yarn, 2, nip rolls; 3 and 11, feed rolls; 4 and 12, a fluid vortex nozzle; 5 and 13, draw rolls; 6, a third delivery roll; 7 and 14, a thick and thin yarn; 8, a spinneret; and 9, an oiling roller.

THE MOST PREFERRED EMBODIMENTS OF THE INVENTION

In the present invention, the fabric obtained by using polyamide based fibers of 5 to 20% Uster Evenness value has a color shade contrast achieved by dyeing and natural irregularity, and furthermore, has microscopic unevenness also on the surface, being provided as a material with dry touch to the eyes and to the touch. The Uster Evenness value is preferably 6 to 18%.

In this case, it is preferable that the number of peaks of 4% or more is 10 or more per meter of yarn, more preferably 15 or more per meter of yarn. The peaks of 4% or more can provide the color shade contrast more effectively, and the existence of many such peaks provides a rustling and elegant dry touch.

In the Uster Evenness value, it is preferable that the relation between the half inert value (H value) and the normal value (N value) is $H/N \leqq 0.8$, more preferably less than 0.6. This keeps the half inert value of the Uster Evenness value small and eliminates the thickness unevenness of tens of centimeters to several meters in periodic length, taken along the length direction of the multifilament.

In the present invention, the standard deviation of stress at 40% elongation in the stress-strain curve with a polyamide-based multifilament sample length of 20 cm, obtained by 10 measurement times, must be 0.3 g/d or less, preferably 0.2 g/d or less, further more preferably less than 0.15 g/d. To keeping the standard deviation at 0.3 g/d or less means keep the periodic length of the thick and thin fibers substantially within the sample length of 20 cm or less, and means that thick and thin portions exist together in the cross-section direction of the multifilament.

In the present invention, it is preferable that the secondary yield stress in the stress-strain curve with a polyamide based multifilament sample length of 20 cm is 0.6 g/d or less and that the breaking elongation is 60 to 200%. More preferably, the secondary yield stress is 0.8 g/d or more and the breaking elongation is 80 to 160%, and further more preferably the secondary yield stress is 0.9 g/d or more and the breaking elongation is 90 to 140%. If the yield stress is 0.6 g/d or more, the permanent strain in the process of knitting or weaving can be inhibited even when the total denier of the polyamide based multifilament is smaller. Furthermore, if the breaking elongation is 60 to 200%, fuzzing in the process of knitting or weaving can be inhibited, and a color shade contrast having short periodic length can be obtained by dyeing, while natural irregularity can be obtained.

In the present invention, the heat shrinkage of the polyamide based multifilament after 15 minutes at 160° C. is preferably 10% or less, more preferably 9% or less, further more preferably 8% or less. If the heat shrinkage is 10% or less, more excellent color fastness can be obtained.

The production process of the present invention is described below.

The thick and thin polyamide based fibers of the present invention can be obtained by a process, in which an undrawn polyamide based multifilament of $20\times10^{-3}$ or less in birefringence $\Delta n$ is drawn at a low ratio to produce a thick and thin yarn, comprising the steps of false-twisting at a position between a feed roller and a draw roller, drawing from 1.5 to 2.5 times, and thermosetting at 100° C. to 200° C.

This is very effective especially for obtaining a thick and thin polyamide based fiber yarn having short periodic length. Furthermore, it is very effective for obtaining a thick and thin yarn in which thick and thin portions exist together along the cross-section direction of the multifilament.

If the birefringence $\Delta n$ of the undrawn polyamide based multifilament is $20\times10^{-3}$ or less, the lengthwise swelling of the undrawn polyamide based multifilament due to moisture absorption can be inhibited, and stable quality can be obtained in mass production.

The draw ratio is generally set as desired in the residual elongation range of the undrawn polyamide based multifilament. However, in the present invention, since it is intended to produce a thick and thin yarn in which thick and thin portions substantially exist together, the draw ratio is set at a low range of 1.5 to 2.5 times. If the draw ratio is in this range, the draw point can be finely adjusted in the narrow range near the heat setting device and/or at the inlet of the heat setting device. In this case, the surface temperature of the feed roller is preferably 80° C. or lower, more preferably 70° C. or lower, further more preferably 50° C. or lower. The reason is that if the surface temperature of the feed roller is lower, the draw point can be finely regulated in the narrow range near the heat setting device and/or at the inlet of the heat setting device.

For false twisting, any conventional false twisting tool can be used. Especially a fluid vortex nozzle can be preferably used. A fluid vortex nozzle causes very little damage to the multifilament running in the drawing zone. So also to obtain a thick and thin yarn at high speed, very little yarn breaking occurs, and the decline in the physical properties of the yarn is small. Thus, it is excellent for productivity. The multifilament product of the present invention obtained has mainly thick and thin portions finely distributed at a short pitch, but has its false twist only a little crimped.

In the process of the present invention, the multifilament running that is in the drawing zone, while being drawn at a low ratio at a draw stress of 0.3 to 0.6 g/d, is false twisted and ballooned by a fluid vortex nozzle. As a result, at first, the multifilament that is upstream of the fluid vortex nozzle is torsionally transformed by false twisting, to be finely strainedly transformed at random along the length direction of fibers constituting the multifilament, and in succession, the multifilament downstream of the fluid vortex nozzle is untwisted and is intermittently brought into contact with the heat setting device by vibration due to ballooning, causing the draw point to be finely changed in the narrow range near the heat setting device and/or at the inlet of the heat setting device. As a result, thick and thin portions are finely distributed in the length direction and in the cross-section direction of the multifilament. So, a thick and thin yarn having periodic variations as short as less than 20 cm in periodic length can be obtained without being affected by the length of the draw zone. Because of this, the Uster Evenness value becomes small, and the color shade contrast periodic length achieved by dyeing is greatly reduced, but a random color shade contrast that is short in periodic length can be obtained. This provides a sprinkly colored grandrelle effect and natural irregularity. As described before, to obtain a thick and thin yarn that is short in periodic length, the actions of false twisting and ballooning are important. For stable false twisting and ballooning, it is preferable to use yarn guides before and after the fluid vortex nozzle.

In the present invention, the heat setting method is not especially limited. However, it is preferable to thermoset under tension using a heat setting device such as a hot draw roller, a hot plate or hot pins. Thermosetting under tension inhibits the relaxation in the orientation of molecular chains otherwise caused by thermosetting, and can greatly improve the washing fastness of the dyed fabric preferably. The method of thermosetting under tension is not especially limited, but a contact type or contact-less type hot plate can be used. Furthermore, it can also be effected by making the surface aventurine by a hot draw roller to decrease the friction between the multifilament and the roller surface, and also by using the hot pins on the aventurine surface, etc.

The heat setting temperature is preferably 100° C. to 200° C., more preferably 120° C. to 160° C. The heat setting temperature in this case refers to the surface temperature of the heat setting device in contact with the multifilament if the heat setting device is of the contact type, or the atmosphere temperature of a multifilament passage if the heat setting device is of the contact-less type.

A preferable production method of the present invention is described below in reference to the drawings.

FIG. 1 shows a method for producing a thick and thin yarn using a melt-spun and once wound undrawn yarn. An undrawn yarn 1 having $20\times10^{-3}$ or less in birefringence guided through nipping rollers 2 is ballooned by a fluid vortex nozzle 4 at an air pressure of 0.5 to 5 kg/cm$^2$ while it is running between a first delivery roller 3 (feed roller) and a second delivery roller 5 (draw roller), and is concurrently drawn at a low ratio of 1.5 to 2.5 times, and in succession, it is thermoset by the second delivery roller 5 at 100° C. to 200° C., then being delivered by a third delivery roller 6, to be wound as a thick and thin yarn 7.

Figure 2:
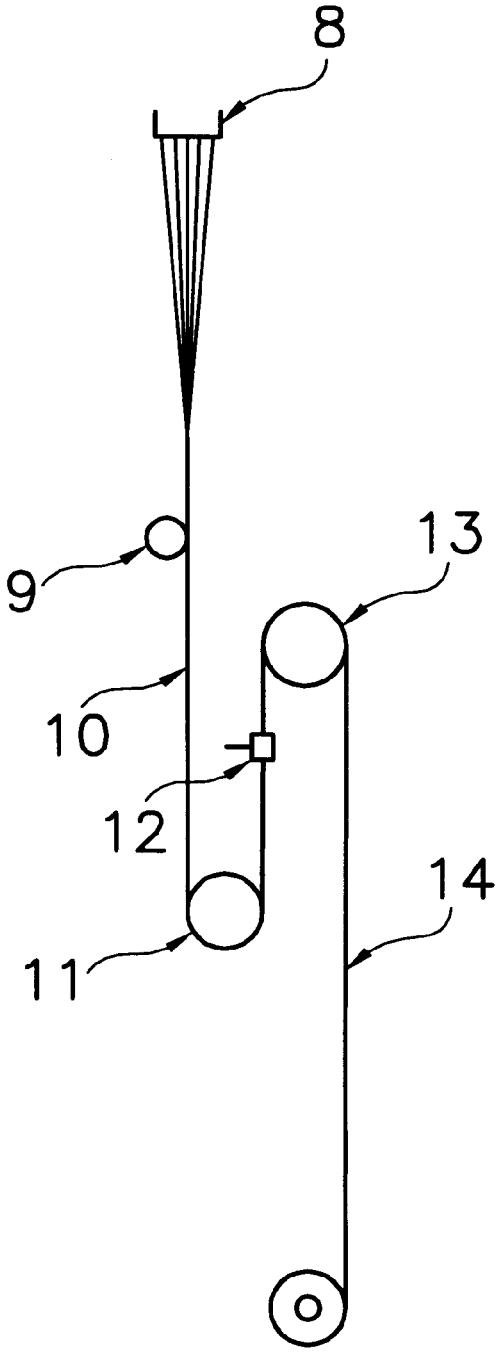
FIG. 2 is another example of a yarn forming machine, useful in the present invention for producing a thick and thin yarn by direct spin drawing.

FIG. 2 shows a method for producing a thick and thin yarn by drawing immediately after spinning without winding the melt-spun undrawn yarn. An undrawn yarn 10 of $20\times10^{-3}$ or less in birefringence melt-spun from a spinneret 8 is oiled by an oiling roller 9, and ballooned by a fluid vortex nozzle 12 at an air pressure of 0.5 to 5 kg/cm$^2$ while it is running between a first delivery roller (feed roller) and a second delivery roller 13 (draw roller), and is concurrently drawn at a low ratio of 1.5 to 2.5 times, and in succession it is thermoset by the second delivery roller 13 at 100° C. to 200° C., then being wound as a thick and thin yarn 14.

The polyamides which can be used in the present invention include nylon 6, nylon 66, nylon 46, nylon 9, nylon 610, nylon 11, nylon 12, nylon 612, etc., and polyamide copolymers consisting of any of these polyamides and a compound with an amide forming functional group such as laurolactam, sebacic acid, terephthalic acid or isophthalic acid. Among them, especially, nylon 6 and nylon 66 are preferable.

The polyamide fibers of the present invention can contain a moisture or water absorbable material such as polysodium acrylate, poly-N-vinylpyrrolidone, polyacrylic acid or any of its copolymers, polymethacrylic acid or any of its copolymers, polyvinyl alcohol or any of its copolymers, crosslinked polyethylene oxide based polymer, etc., and a general purpose thermoplastic resin such as a polyamide, polyester or polyolefine, to such an extent that the object of the present invention is not impaired. Furthermore, a pigment such as titanium oxide or carbon black and conventional publicly known antioxidant, anticoloring agent, light resisting agent, antistatic agent, etc. can also be added.

The sectional form of the polyamide fibers is not limited to round, but can be a polygon, H form, π form, C form, flat form, flat multi-lobed form or any other known modified cross-section. Furthermore, mixed fibers or conjugated fibers consisting of a polyamide and another melt-spinnable thermoplastic polymer can also be used. The fabric can be a woven fabric, knitted fabric or nonwoven fabric, etc., and any of these fabrics can be selected properly to suit the respective purposes. Because of a small color shade contrast achieved by dyeing, natural irregularity and microscopic unevenness on the surface of the fabric, a material with dry touch to the eyes and by touch can be obtained.

The methods for calculating the evaluation values in the present invention are described below:

(1) Uster Evenness value: The unevenness of thickness in the length direction of a multifilament is measured by Uster Tester Monitor C (produced by Zellweger USTER). The average deviation of Uster Evenness values is measured at a yarn speed of 8 m/min, with twist Z 1.5, at a yarn tension of 1.5 for an evaluation time of 1 minute in 100% range in the normal (N) and half inert (H) modes, and the wave form is recorded in the chart. Measurement is executed at three optional points of a sample, and the average value is used. From the normal chart, the number of the peaks of 4% or more is counted, and the number of peaks per 1 m of yarn length is calculated.

(2) Tensile strength, tensile elongation and standard deviation of the stress at 40% elongation: The tensile strength and tensile elongation are measured by a tensilon tensile testing machine (Tensilon UTM-III-100 produced by Toyo Baldwin) according to JIS L 1013. A stress-strain curve is obtained with a sample multifilament yarn length of 20 cm at a tensile speed of 20 cm/min, and the fineness measured separately is used for calculation. The average value of 10 times of measurement is used. Furthermore, from the stress-strain curve obtained here, the stress at 40% elongation is calculated, and the standard deviation of stress by 10 times of measurement is calculated.

(3) Secondary yield stress: In the stress-strain curve of the above (2), the secondary yield tension is obtained, and the fineness measured separately is used for calculation. The average value of 10 times of measurement is used.

(4) Heat shrinkage: This is measured according to JIS L 1013 Method A under the following conditions. A hank sample is prepared by a sizing reel, and neglected for 2 hours, and air-conditioned. Then, a load of 1/30 (g/d) is applied, and 30 seconds later, the sample length is measured as $L_0$. The sample with both the ends kept free is put in an oven type dryer, and heat-treated at 160° C. for 20 minutes. After completion of heat treatment the sample is taken out of the oven, allowed to cool and air-conditioned for 2 hours indoors. The cooled and air-conditioned sample is loaded again at 1/30 (g/d), and 30 seconds later, the sample length is measured as L. The heat shrinkage is obtained from the following formula:

$$\text{Heat shrinkage } (\%)=[(L_0-L)/L_0]\times 100$$

The sample is measured at optional five points, and the average value is used.

(5) Shrinkage in boiling water: Measured according to JIS L 1013 Method A.

(6) Density: Measured according to the density-gradient tube method of JIS L 1013.

(7) Birefringence: Measured according to the compensator method using polarizing microscope BH-2 produced by Olympus. The air conditioning conditions of (1) to (7) are 20±2° C. and 65±2% relative humidity.

(8) Wash fastness: A sample was treated according to method A-2 of JIS L 0844 "Methods for Testing Color Fastness in Washing", and the degree of fading after washing compared to the color before washing is judged in reference to the following criterion using the gray scale.

Grade 5: No fading was observed at all.

Grade 4: Little fading was observed.

Grade 3: A little fading was observed.

Grade 2: Fading was observed.

Grade 1: Heavy fading was observed.

(9) Light fastness: Measured according to JIS L 0842 "Method for Testing Color Fastness by Carbon Arc Lamp Light". With 10-hour irradiation as grade 3, 20-hour irradiation as grade 4 and 40-hour irradiation as grade 5, the fading of a sample was judged in reference to the fading of blue scale using the gray scale.

The dyeing conditions are as follows:

| | | |
|---|---|---|
| Scouring conditions: | | |
| Soda ash | 1 | g/liter |
| Glan Up US-20 (produced by Sanyo Chemical Industries, Ltd.) | 0.5 | g/liter |
| Bath ratio | 1:50 | |
| Temperature × time | 60° C. × 60 | min |
| Dyeing conditions: | | |
| Dye (Milling acid dye produced by Sand) PH-500 | 0.5 | g/liter |
| Nylosan Gold Yellow N-4RL | 0.5% | owf |
| Nylosan Red N-GZN | 0.5% | owf |
| Nylosan Blue N-GFL 167% | 1.0% | owf |
| Level dyeing agent: Newpon TS-400 | 3% | owf |
| Bath ratio | 1:20 | |
| Temperature × time | 98° C. × 60 | min |
| Fix treatment conditions: | | |
| Fixing agent: Sunlife TA-50K (produced by Nikka Kagaku K.K.) | 5% | owf |
| Acetic acid | 0.5 | g/liter |
| Bath ratio | 1:20 | |
| Temperature × time | 80° C. × 20 | min |

The present invention is described below in detail in reference to examples.

EXAMPLE 1

Nylon 6 polymer of 2.63 in relative viscosity in sulfuric acid was melt-spun at 260° C. and at a spinning speed of 800 m/min, to obtain an undrawn multifilament of 220 deniers and $12\times10^{-3}$ in birefringence consisting of 24 filaments. The undrawn yarn was drawn at a drawing speed of 800 m/min by a drawing machine shown in FIG. 1 under various drawing conditions, to obtain thick and thin multifilament yarns respectively consisting of 24 filaments. The drawing conditions and properties of the thick and thin yarns are shown in Table 1.

EXPERIMENT NOS. 1 to 4

The thick and thin yarns of the present invention in experiment Nos. 1 to 4 are 5 to 17% in Uster Evenness value in the length direction of the multifilament and 3 to 8% in heat shrinkage at 160° C. Furthermore, the stress at 40% elongation in the stress-strain curve with a sample length of 20 cm was calculated with each sample, and the standard deviation of the stress after 10 times of measurement was as small as 0.03 to 0.27 g/d.

Then, each of the thick and thin multifilament yarns shown in Table 1 was woven into a plain woven fabric at a woven fabric density of 90×75 threads/inch, and the gray fabric was set by a 180° C. stenter, scoured, dyed by an acid dye, fix-treated and set for finishing by a 160° C. stenter, to prepare a fabric sample.

The respective fabric samples were microscopically uneven on the surfaces, and hence, rich in dry tough and rustling touch. Furthermore, as color fastness, both the wash fastness and light fastness were of grade 4 or higher. Furthermore, the difference of color shade due to dyeing was manifested, and in synergism with the surface unevenness, natural irregularity like spun could be obtained.

COMPARATIVE EXAMPLE 1

A fabric sample was prepared under the same drawing conditions as in Experiment No. 1, except that no fluid vortex nozzle was used.

The drawing conditions and properties of the thick and thin yarn are shown in Table 1. The thick and thin yarn of Comparative Example 1 was 20% in the Uster Evenness value in the length direction of the multifilament and was as very dispersed as 0.5 g/d in the standard deviation of the stress at 40% elongation.

The woven fabric sample was uneven on the surface, and hence, rich in dry touch and rustling touch. However, as for color fastness, both the wash fastness and light fastness were of grade 3, to show fading, and the product was almost marginally practical. Furthermore, the difference of color shade due to dyeing and the periodic length of thick and thin portions were large, to degrade the beauty, and the grade as a product was poor.

COMPARATIVE EXAMPLE 2

A fabric sample was prepared under the same drawing conditions as in Experiment No. 1, except that the heat setting temperature (draw roller temperature) was 30° C.

The drawing conditions and properties of the thick and thin yarn are shown in Table 1. The thick and thin yarn of Comparative Example 2 was 18% in the Uster Evenness value in the length direction of the multifilament and was as very dispersed as 0.4 g/d in the standard deviation of the stress at 40% elongation. The heat shrinkage at 160° C. was as high as 13%, and the density was as low as 1.130 g/cm$^3$. So, the woven fabric sample was uneven on the surface and rich in dry touch and rustling touch. However, as for color fastness, both the wash fastness and light fastness were of grade 2 to 3, to show that the product was not practical. Furthermore, since the difference of color shade due to dyeing was large, the grade as a product was poor.

COMPARATIVE EXAMPLE 3

A fabric sample was prepared under the same drawing conditions as in Experiment No. 1, except that the feed roller temperature was 90° C. and that the heat setting temperature (draw roller temperature) was 210° C.

The drawing conditions and properties of the thick and thin yarn are shown in Table 1. The thick and thin yarn of Comparative Example 3 was as small as 2% in the Uster Evenness value in the length direction of the multifilament, and the woven fabric did not look uneven on the surface. So, the product was poor in dry touch and rustling touch. Furthermore, as for color fastness, both the wash fastness and light fastness were of grade 2 to 3, to show that the product was not practical. Moreover, the difference of color shade due to dyeing was poor, and the grade as a product was poor.

TABLE 1

| | Experiment No.1 | Experiment No.2 | Experiment No.3 | Experiment No.4 | Comparative example 1 | Comparative example 2 | Comparative example 3 |
|---|---|---|---|---|---|---|---|
| Birefringence of undrawn yarn (Δn × $10^{-3}$) | 12 | 12 | 12 | 12 | 12 | 12 | 12 |
| Feed roller temperature (°C.) | 40 | 60 | 50 | 30 | 40 | 30 | 90 |
| Air pressure of vortex nozzle (Kg/cm$^2$) | 2.0 | 1.6 | 3.0 | 2.5 | — | 2.0 | 2.0 |
| Drawing ratio (times) | 2.0 | 2.0 | 2.2 | 2.5 | 2.0 | 2.0 | 2.0 |
| Heat setting temperature (draw roller temperature) (°C.) | 140 | 120 | 170 | 150 | 140 | 30 | 210 |
| Surface of draw roller | Mirror finished surface | Mirror finished surface | Mirror finished surface | Mirror finished surface | Mirror finished surface | Mirror finished surface | Mirror finished surface |
| Drawing speed (m/min) | 800 | 800 | 800 | 800 | 800 | 800 | 800 |
| Tensile strength (g/d) | 3.5 | 2.8 | 2.3 | 4.0 | 3.5 | 3.0 | 2.3 |
| Tensile elongation (%) | 120 | 140 | 95 | 83 | 120 | 120 | 30 |
| Standard deviation of the stress at 40% elongation (g/d) | 0.10 | 0.27 | 0.25 | 0.03 | 0.50 | 0.40 | 0.04 |
| Secondary yield stress (g/d) | 1.52 | 0.90 | 1.86 | 1.25 | 0.45 | 0.60 | 0.40 |
| Shrinkage in boiling water (%) | 5 | 10 | 5 | 8 | 6 | 18 | 2 |
| Heat shrinkage at 160° C. (%) | 3 | 8 | 3 | 7 | 5 | 13 | 1 |
| Birefringence (Δn × $10^{-3}$) | 35 | 31 | 36 | 45 | 27 | 25 | 30 |
| Density (g/cm$^3$) | 1.134 | 1.132 | 1.135 | 1.136 | 1.134 | 1.130 | 1.137 |
| Uster Evenness value | 8 | 15 | 17 | 5 | 20 | 18 | 2 |
| Number of the peaks of 4% or more (pcs/m) | 23 | 25 | 20 | 17 | 9 | 5 | 3 |
| H/N ratio | 0.25 | 0.70 | 0.60 | 0.40 | 0.95 | 0.92 | 0.52 |
| Wash fastness (grade) | 4–5 | 4 | 4 | 4–5 | 3 | 2–3 | 2–3 |
| Light fastness (grade) | 4–5 | 4–5 | 4–5 | 4–5 | 3 | 2–3 | 2–3 |

EXAMPLE 2

Nylon 6 polymer of 2.63 in relative viscosity in sulfuric acid was melt-spun at 260° C. and at a spinning speed of 1000 m/min by a direct spin drawing machine shown in FIG. 2, and drawn to twice, to obtain a thick and thin multifilament yarn of 110 deniers consisting of 24 filaments. The drawing conditions and properties of the thick and thin yarn are shown in Table 2. An undrawn yarn obtained by melt-spinning at a spinning speed of 1000 m/min and winding it without drawing was $16\times10^{-3}$ in birefringence.

EXPERIMENT NOS. 5 and 6

The thick and thin yarns of Experiment Nos. 5 and 6 of the present invention were 9 to 12% in the Uster Evenness value in the length direction of the multifilament and 3 to 8% in the heat shrinkage at 160° C. Furthermore, the stress at 40% elongation in the stress-strain curve with a sample length of 20 cm was calculated, and the standard deviation after 10 times of measurement was as small as 0.05 to 0.15 g/d.

The thick and thin multifilament yarns shown in Table 2 were woven into plain woven fabrics at a woven fabric density of 90×75 threads/inch, and the gray fabrics were set by a 180° C. stenter, scoured, dyed by an acid dye, fix-treated and set for finishing to prepare fabric samples.

The woven fabric samples were microscopically uneven on the surfaces, and hence, rich in dry touch and rustling touch. As for color fastness, both the wash fastness and light fastness were of grade 4 or more. The difference of color shade due to dyeing was manifested, and in synergism with the surface unevenness, natural irregularity like spun could be obtained.

COMPARATIVE EXAMPLE 4

A fabric sample was prepared under the same direct spin draw conditions as in Experiment No. 5, except that no fluid vortex nozzle was used. The drawing conditions and properties of the thick and thin yarn are shown in Table 2. The thick and thin yarn of Comparative Example 4 was 22% in the Uster Evenness value in the length direction of the multifilament and 0.4 g/d in the standard deviation of the stress at 40% elongation, being 5% in heat shrinkage at 160° C.

The woven fabric sample was uneven on the surface and hence, rich in dry touch and rustling touch. As for color fastness, both the wash fastness and light fastness were of grade 3, to show fading, and the sample was almost marginally practical. Furthermore, the difference of color difference due to dyeing and the periodic length of thick and thin portions were large to degrade the beauty, and the grade as a product was poor.

COMPARATIVE EXAMPLE 5

A fabric sample was prepared under the same direct spin draw conditions as in Experiment No. 5, except that the heat setting temperature (draw roller temperature) was 25° C.

The drawing conditions and properties of the thick and thin yarn are shown in Table 2. The thick and thin yarn of Comparative Example 5 was 25% in the Uster Evenness value in the length direction of the multifilament, and 0.4 g/d in the standard deviation of the stress at 40% elongation, being 12% in the heat shrinkage at 160° C.

The woven fabric sample was uneven on the surface, and hence, rich in dry touch and rustling touch, presenting hardening hands.

As for color fastness, both the wash fastness and light fastness were of grade 3, to show fading, and the product was almost marginally practical. Furthermore, the difference of color shade due to dyeing and the periodic length of thick and thin portions were large, to degrade beauty, and the grade as a product was poor.

TABLE 2

| | Experiment No.5 | Experiment No.6 | Comparative example 4 | Comparative example 5 |
|---|---|---|---|---|
| Birefringence of undrawn yarn ($\Delta n \times 10^{-3}$) | 16 | 16 | 16 | 16 |
| Feed roller temperature (°C.) | 25 | 50 | 25 | 25 |
| Air pressure of vortex nozzle ($Kg/cm^2$) | 3 | 2 | — | 2 |
| Drawing ratio (times) | 2.0 | 1.8 | 2.0 | 2.0 |
| Heat setting temperature (draw roller temperature) (°C.) | 180 | 150 | 180 | 25 |
| Surface of draw roller | Mirror finished surface | Mirror finished surface | Mirror finished surface | Mirror finished surface |
| Drawing speed (m/min) | 2000 | 1800 | 2000 | 2000 |
| Tensile strength (g/d) | 3.3 | 3.5 | 3.0 | 2.8 |
| Tensile elongation (%) | 80 | 120 | 110 | 120 |
| Standard deviation of the stress at 40% elongation (g/d) | 0.05 | 0.15 | 0.4 | 0.4 |
| Secondary yield stress (g/d) | 1.15 | 0.9 | 0.58 | 0.50 |
| Shrinkage in boiling water (%) | 5 | 14 | 5 | 18 |
| Heat shrinkage at 160° C. (%) | 3 | 8 | 5 | 12 |
| Birefringence ($\Delta n \times 10^{-3}$) | 40 | 35 | 28 | 25 |
| Density ($g/cm^3$) | 1.135 | 1.134 | 1.135 | 1.132 |
| Uster Evenness value | 9 | 12 | 22 | 25 |
| Number of the peaks of 4% or more (pcs/m) | 24 | 20 | 8 | 6 |
| H/N ratio | 0.20 | 0.50 | 0.87 | 0.93 |
| Wash fastness (grade) | 4–5 | 4 | 3 | 3 |
| Light fastness (grade) | 4–5 | 4–5 | 3 | 3 |

EXAMPLE 3

Nylon 6 polymer of 2.63 in relative viscosity in sulfuric acid was melt-spun at 260° C. and at different spinning speeds, to obtain undrawn yarns of 220 deniers consisting of 24 filaments respectively and different in birefringence Δn. The undrawn yarns were heated by a hot plate of 150° C. and 20 cm in length installed (heat setting temperature 150° C.) between the fluid vortex nozzle 4 and the second delivery roller 5 of the drawing machine shown in FIG. 1, and drawn without heating the first delivery roller 3 and the second delivery roller 5, to obtain thick and thin multifilament yarns. The surface temperature of the first delivery roller measured by a surface thermometer was 30° C., and the surface temperature of the second delivery roller 5 was 45° C. The drawing conditions and properties of the thick and thin yarn are shown in Table 3. The thick and thin multifilament yarns of Table 3 were woven into plain woven fabrics at a woven fabric density of 90×75 threads/inch, and the gray fabrics were set by a 180° C. stenter, scoured according to a conventional method, dyed by an acid dye, fix-treated and set for finishing by a 160° C. stenter, to prepare fabric samples.

The woven fabric samples of Experiment Nos. 7 and 8 were microscopically uneven, and hence, rich in dry touch and rustling touch. As for color fastness, both the wash fastness and light fastness were of grade 4 or higher. The difference of color shade due to dyeing was manifested, and in synergism with the surface unevenness, natural irregularity like spun could be obtained.

The woven fabric sample of Experiment No. 9 was microscopically uneven on the surface, and hence, rich in dry touch and rustling touch. Both the wash fastness and light fastness were of grade 4, to show that the product could be sufficiently practical.

COMPARATIVE EXAMPLE 6

An undrawn yarn of $22\times10^{-3}$ in birefringence $\Delta n$ was obtained as described in Example 3, except that the spinning speed was changed. The undrawn yarn was drawn under the drawing conditions shown in Table 3, to obtain a drawn yarn of Comparative Example 6. The properties of the drawn yarn and the fabric sample obtained from it are shown in Table 3.

Since the Uster Evenness value was 4%, the surface unevenness of the woven fabric was insufficient, and hence, dry touch and rustling touch could not be obtained. Furthermore, the difference of color shade due to dyeing was small, and the wash fastness was of grade 3, to show fading. The product was almost marginally practical in this sense. The light fastness was of grade 4, to show that the product was sufficiently practical in this sense. Moreover, the heat shrinkage was high, and so the hands of the fabric sample were somewhat hard.

COMPARATIVE EXAMPLE 7

The undrawn yarn of Experiment No. 7 was drawn under the drawing conditions shown in Table 3, to obtain a drawn yarn of Comparative Example 7. The properties of the drawn yarn and the fabric sample obtained from it are shown in Table 3. The woven fabric sample of Comparative Example 7 was uneven on the surface, and hence, rich in dry touch and rustling touch. However, the difference of color shade due to dyeing and the periodic length of thick and thin portions were very large, to degrade the beauty. Furthermore, the wash fastness was as low as grade 2 and the light fastness was as low as grade 3, to show that the product was not practical. Moreover, since the secondary yield stress was low, permanent strain was likely to remain disadvantageously when the yarn was woven into a fabric and when the fabric was worn by a person.

TABLE 3

| | Experiment No.7 | Experiment No.8 | Experiment No.9 | Comparative example 6 | Comparative example 7 |
|---|---|---|---|---|---|
| Birefringence of undrawn yarn ($\Delta n \times 10^{-3}$) | 12 | 15 | 12 | 22 | 12 |
| Feed roller temperature (°C.) | 30 | 30 | 30 | 30 | 30 |
| Air pressure of vortex nozzle (Kg/cm$^2$) | 1.7 | 2.5 | 2.0 | 3.0 | 3.0 |
| Drawing ratio (times) | 1.8 | 2.2 | 2.0 | 2.7 | 1.4 |
| Heat setting temperature (draw roller temperature) (°C.) | 150 | 150 | 150 | 150 | 150 |

TABLE 3-continued

| | Experiment No.7 | Experiment No.8 | Experiment No.9 | Comparative example 6 | Comparative example 7 |
|---|---|---|---|---|---|
| Surface of draw roller | Mirror finished surface | Mirror finished surface | Mirror finished surface | Mirror finished surface | Mirror finished surface |
| Drawing speed (m/min) | 800 | 800 | 800 | 800 | 800 |
| Tensile strength (g/d) | 2.5 | 3.7 | 2.6 | 2.7 | 2.8 |
| Tensile elongation (%) | 140 | 70 | 150 | 50 | 210 |
| Standard deviation of the stress at 40% elongation (g/d) | 0.15 | 0.05 | 0.10 | 0.04 | 0.60 |
| Secondary yield stress (g/d) | 0.9 | 1.4 | 0.7 | 1.8 | 0.5 |
| Shrinkage in boiling water (%) | 13 | 14 | 12 | 18 | 8 |
| Heat shrinkage at 160° C. (%) | 8 | 9 | 7 | 12 | 4 |
| Birefringence ($\Delta n \times 10^{-3}$) | 35 | 45 | 36 | 48 | 28 |
| Density (g/cm$^3$) | 1.131 | 1.134 | 1.134 | 1.137 | 1.128 |
| Uster Evenness value | 14 | 9 | 10 | 4 | 25 |
| Number of the peaks of 4% or more (pcs/m) | 27 | 20 | 22 | 9 | 14 |
| H/N ratio | 0.64 | 0.43 | 0.57 | 0.34 | 0.97 |
| Wash fastness (grade) | 4–5 | 4–5 | 4 | 3 | 2 |
| Light fastness (grade) | 4–5 | 4–5 | 4 | 4 | 3 |

INDUSTRIAL APPLICABILITY

The polyamide based fibers of the present invention have dry touch and rustling touch and manifest the difference of color shade short in periodic length when dyed, to present natural irregularity. Furthermore, since the fabric has also microscopic unevenness on the surface, a material with dry touch to the eyes and by touch can be obtained, and furthermore, a material or product good in color fastness can also be provided. The production process thereof is also excellent in industrial stability.

We claim:

1. Thick and thin polyamide based fiber, having alternating thick and thin uneven fiber cross sections extending along the fiber length, wherein the unevenness of thickness in the length direction of the polyamide based multifilament is 5 to 20% when measured as the Uster Evenness value, and wherein the standard deviation of the stress at 40% elongation in the stress-strain curve of said multifilament, with a sample length of 20 cm, is 0.3 g/d or less.

2. Thick and thin polyamide based fibers, according to claim 1, wherein the number of the peaks of 4% or more is 10 measuring more per meter of yarn length on the chart of Uster Evenness values.

3. Thick and thinopolyamide based fibers, according to claim 1 or 2, wherein the relation between the half inert, value (H value) and the normal value (N value) in Uster Evenness values is $H/N \leqq 0.8$.

4. Thick and thin polyamide based fiber, according to claim 1, wherein the secondary yield stress of said multifilament is 0.6 g/d or more in the stress-strain curve with a sample length of 20 cm of the polyamide based multifilament, and wherein the breaking elongation of said multifilament is 60 to 200%.

5. Thick and thin polyamide based fibers, according to claim 1, wherein the heat shrinkage of said multifilament at 160° C. is 10% or less.

6. A process for producing thick and thin polyamide based fibers, in which an undrawn polyamide based multifilament of $20\times10^{-3}$ or less in birefringence $\Delta n$ is drawn at a low ratio to produce a thick and thin yarn, comprising the steps of false twisting said multifillament at a position between a feed roller and a draw roller, drawing it from 1.5 to 2.5 times, and thermosetting at 100° C. to 200° C.

7. A process for producing thick and thin polyamide based fibers, according to claim 6, wherein the undrawn multifilament is ballooned by a fluid vortex nozzle at a position between the feed roller and the draw roller.

8. A process for producing thick and thin polyamide based fibers, according to claim 6, wherein the surface temperature of the feed roller is 80° C. or lower.

9. A process for producing thick and thin polyamide based fibers, according to claim 6, wherein the thermosetting step is effected by a hot plate.

* * * * *

UNITED STATES PATENT AND TRADEMARK OFFICE

CERTIFICATE OF CORRECTION

PATENT NO. :5,925,727

DATED :July 20, 1999

INVENTOR(S) :Onda et al.

It is certified that error appears in the above-identified patent and that said Letters Patent is hereby corrected as shown below:

In Column 2,
line 10, please delete "a" after "12,";
line 11, please change "nozzle" to --nozzles--; and
line 44, please change "keep" after "means" to --keeping--.

In Column 3, line 4, please delete "," after "process"; and
line 47, please change "running that is" to --that is running--.

In Column 12, line 55, please change "of 4%" to --measuring 4%--: and
line 56, please change "measuring" to --or--.

Signed and Sealed this

Fourth Day of July, 2000

*Attest:*

Q. TODD DICKINSON

*Attesting Officer*

*Director of Patents and Trademarks*